US005366075A

United States Patent [19]

Mills

[11] Patent Number: 5,366,075

[45] Date of Patent: Nov. 22, 1994

[54] GOLF EQUIPMENT CARRIER WITH ROTATING CLUB FRAME

[76] Inventor: S. Dwight Mills, 1010 American Eagle Blvd., Sun City Center, Fla. 33573

[21] Appl. No.: 86,654

[22] Filed: Jul. 6, 1993

[51] Int. Cl.[5] ..... A63B 55/00; A63B 55/02

[52] U.S. Cl. ..... 206/315.6; 280/DIG. 6

[58] Field of Search ..... 206/315.3, 315.4, 315.5, 206/315.6, 315.7; 280/DIG. 6; 248/96; 211/70.2

[56] References Cited

U.S. PATENT DOCUMENTS

| | | | |
|---|---|---|---|
| 1,418,093 | 5/1922 | Parmater | 280/DIG. 6 X |
| 2,547,829 | 4/1951 | Mills | 211/70.2 X |
| 2,890,061 | 6/1959 | Watson | 280/DIG. 6 X |
| 3,425,708 | 2/1969 | Sato | 206/315.6 |
| 4,111,248 | 9/1978 | Leichhardt | 206/315.6 |
| 4,181,167 | 1/1980 | Ret | 211/70.2 X |
| 4,673,082 | 6/1987 | Hemme | 206/315.3 X |
| 4,709,814 | 12/1987 | Antonious | 206/315.3 |
| 4,753,446 | 6/1988 | Mills | 280/DIG. 6 X |
| 4,852,896 | 8/1989 | Mills | 206/315.3 X |
| 4,915,221 | 4/1990 | Spangler | 206/315.3 X |

*Primary Examiner*—Sue A. Weaver
*Attorney, Agent, or Firm*—Joseph G. Nauman

[57] ABSTRACT

An improved golf club retaining device holds the clubs in place within a generally circular frame, while avoiding any bending stress transverse to the length of the club handle. The central disc of the club frame carries a band or ring of resilient material, e.g. a large O-ring, in a groove around the periphery of the disc. In locations where the club shafts pass this disc, the disc periphery has scallop-like recesses leaving the band without rearward support in those locations. Transverse force against the club shafts is derived only from the tension in the band or O-ring, to hold clubs securely in the frame. The transverse force on the club shafts is insufficient to induce any deformation in those shafts. An integral multiple cup member is provided as the bottom member of the frame, and has outer walls about its periphery which are higher that their inner counterparts. Forces against the butt of a club shaft handle are distributed over a greater part of the handle end.

2 Claims, 3 Drawing Sheets

GOLF EQUIPMENT CARRIER WITH ROTATING CLUB FRAME

FIELD OF THE INVENTION

The present invention relates generally to a carrier for supporting golf clubs, balls, tees and other associated golfing equipment for convenient access and transport as a golfer travels around a golf course, as disclosed in my U.S. Pat. No. 4,852,896 issued 1 Aug. 1989.

BACKGROUND OF THE INVENTION

The golf equipment carrier disclosed in that patent includes an elongated club receiving frame supported for rotation upon a base from which a club protecting cover extends vertically upwardly about the frame and includes an opening extending from the top of the cover downwardly a substantial distance such that clubs can be inserted into and withdrawn from the club receiving frame laterally through the cover. A bottom member of the frame, having a plurality of upwardly directed sockets or receivers distributed thereabout, accepts the ends of inverted club shafts, and a top member of the frame has a corresponding plurality of club engaging slots for receiving and retaining shank portions of the club shafts. The bottom and top members are centrally interconnected by a tubular member open above the top member for receiving a ball retriever, umbrella or other elongated piece of golf equipment. This tubular member extends above the top member so ball holders may be secured to the tubular member above the top member, and also spaces the top and bottom members from one another to form a vertically elongated club receiving frame. The base supports the club receiving frame for rotation about a generally vertical axis and the cover extends upwardly from the base at least to the frame top member.

To ensure stability and long life for the rotatable elongated club receiving frame, the carrier preferably further includes some means for supporting and centering the top member of the frame, such as a platform recessed within and supported upon an upper end of the cover and coextensive therewith, and a plurality of axial extensions projecting from the top member and being sized to engage an inner surface of the cover and bear upon the platform. The top member comprises a generally circular disc-like part having the slots extending radially thereinto, each of the slots terminating in a club receiving pocket extending from its corresponding slot and separated therefrom by a shaft retaining notch. Thus the handle end of a club shaft can be inserted into one of the socket and the shank portion of the club shaft then inserted into a corresponding one of the slots and moved beyond the shaft retaining notch into the corresponding club receiving pocket.

SUMMARY OF THE INVENTION

The present invention provides an improved club retaining means which holds the clubs in place within the frame, while avoiding any bending stress transverse to the length of the club handle. The central disc of the club frame is modified to receive a band or ring of resilient material, e.g. a large 0-ring, in a groove around the periphery of the disc. In the locations where the club shafts pass this disc, the disc periphery is recessed, for example with scallop-like formations, leaving the band without rearward support in those locations. The central transverse force against the club shafts is derived only from the tension in the band or 0-ring. This construction holds the clubs securely in the frame, but the reduced transverse force on the club shafts is insufficient to induce any deformation in those shafts.

Further, and improved type of multiple cup member is fitted to (or a part of) the bottom member of the frame. This cup member has outer walls about its periphery which are higher that their inner counterparts, thus forces against the shaft butt end of the clubs are distributed over a greater part of that end, and the holding effort in that lower area of the club frame is improved. The butt ends of the shafts are still easily inserted and removed.

The primary object of this invention is thus to provide an improved club holder frame for golf equipment carrier, in which the clubs are retained more securely, yet any tendency is overcome to bend slightly any club shafts; to provide such an improved holder frame with a central disc construction which imparts a limited force via a resilient ring which does not have backing in the region where it contacts club shafts; and to provide a novel integrally constructed bottom member for such frame including unique cup members for receiving the butt ends of club shafts.

Other objects and advantages of the invention will be apparent from the following description, the accompanying drawings and the appended claims.

DETAILED DESCRIPTION OF THE INVENTION

Figure 1:
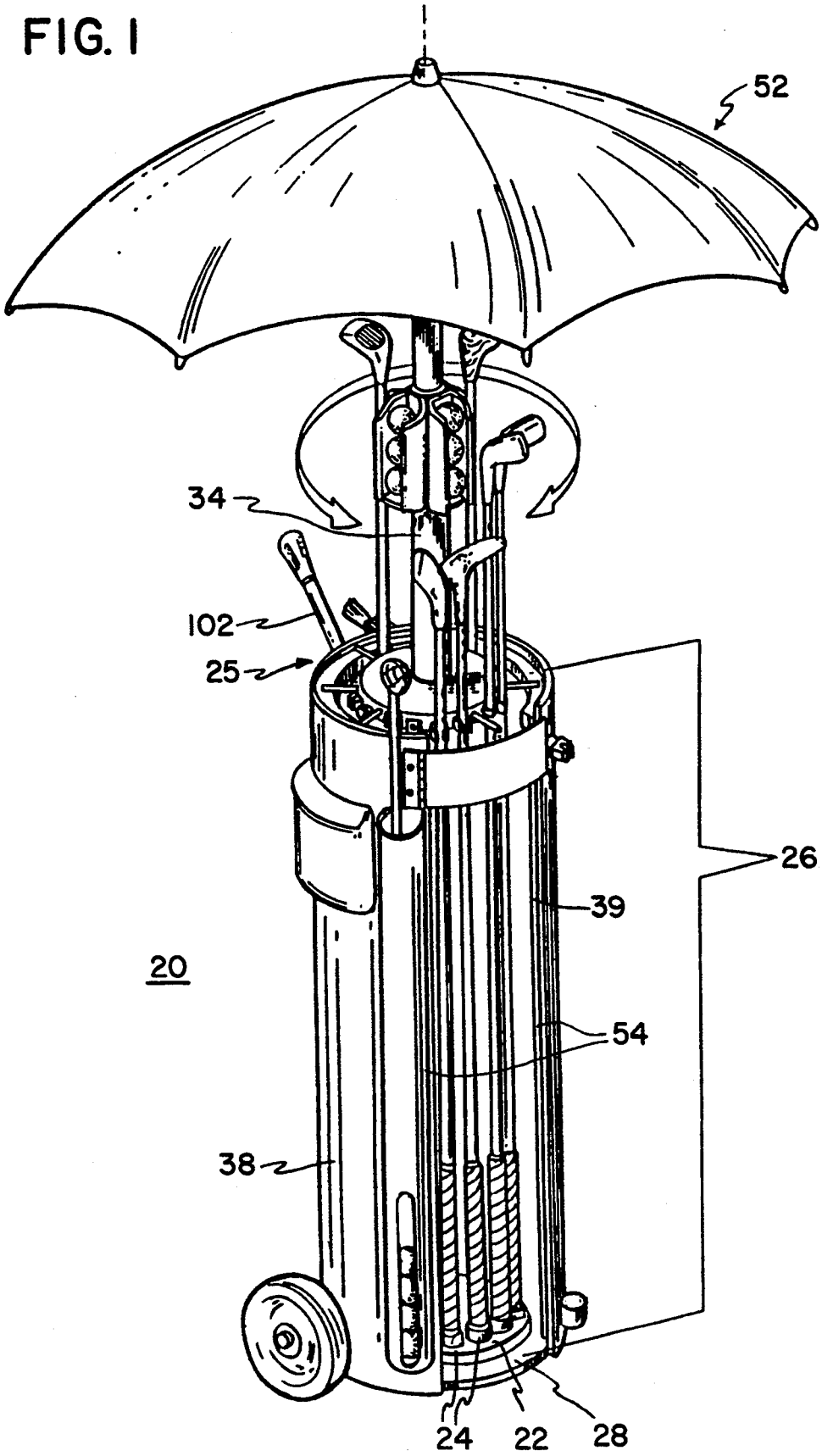
FIG. 1 (marked Prior Art) is a perspective over-all view of a golf equipment carrier in accordance with the prior patent.
Figure 2:
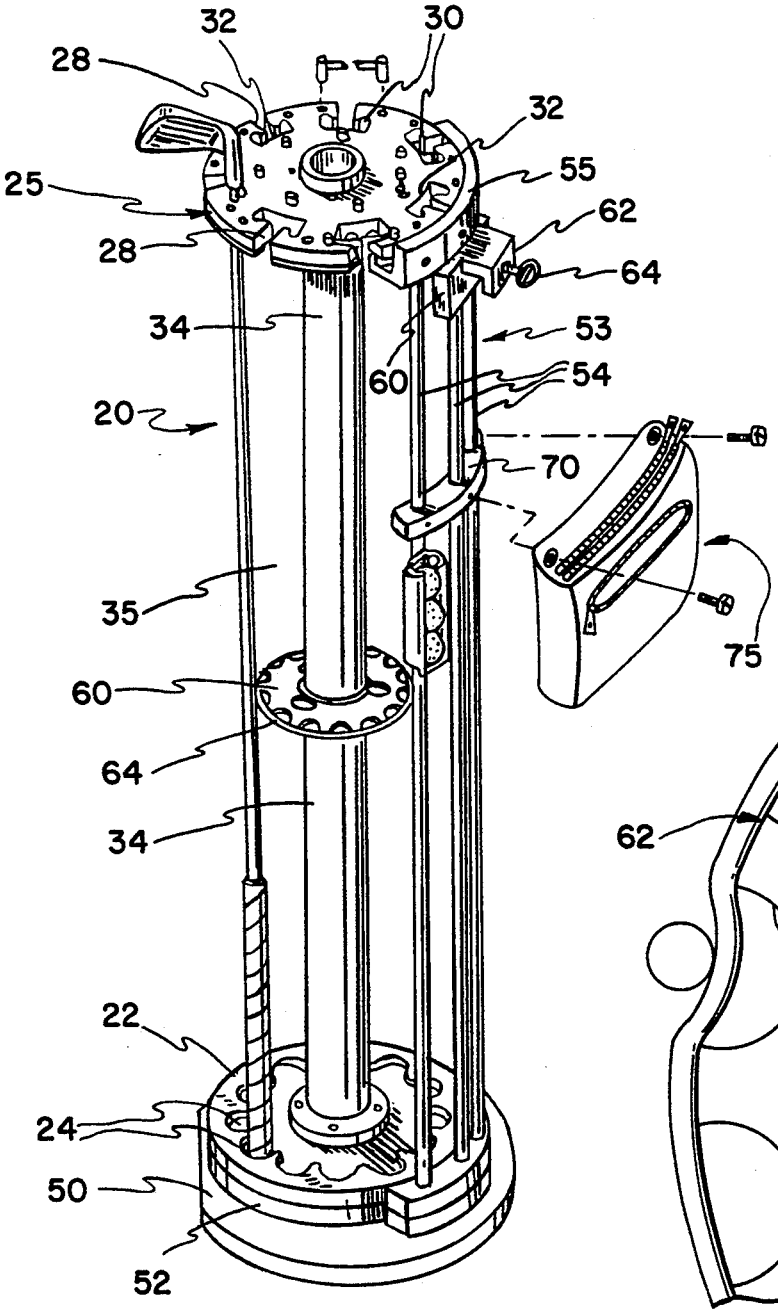
FIG. 2 shows the club receiving frame incorporating an improved spreader or retaining disc.

FIG. 1 is a perspective view of a golf equipment carrier as disclosed in said prior U.S. Pat. No. 4,852,896; the same reference numerals are used to identify like parts. The golf carrier 20 of the present invention is particularly adaptable for use on a powered golf cart as described in said prior patent, or wheels may be attached to the golf carrier, and a pull handle 102 may be connected to the carrier 20. FIG. 2 is a view similar to FIG. 1 of prior U.S. Pat. No. 4,753,446, showing a modified form of central snubber disc for holding the clubs in the frame.

Carrier 20 comprises a circular bottom member 22 having a plurality of upwardly directed socket means comprising tubular cup members 24 evenly distributed about the bottom member 22. A top member 25, has a corresponding plurality of club engaging slots 32 sized and distributed for receiving and retaining shank portions of club shafts to be retained within the carrier. Top member 25 comprises a circular central part having an outer annular surface and having fourteen dual slots 20 formed therein (one each for a set of fourteen clubs), with radially extending slots 28 forming passages to the exterior or rim of member 25. A central tubular member 34 interconnects the top member 25 and the bottom member 22, and provides spacing of the top and bottom members from one each other to form a vertically elongated club receiving frame designated by the general numeral 26.

A base plate 28 supports the club receiving frame 26 for rotation about a generally vertical axis passing through the tubular member 34, and cover sleeve 38 extends between and is secured to base plate 28 and a semi-circular upper platform 40 (a portion shown in FIG. 2) which has a slot receiving and centering a depending ring 25A on the bottom of circular top member 25. Cover 38 protects clubs supported upon the club receiving frame 26, and includes an opening 39 which extends from platform 40 a substantial distance toward the bottom or base plate 28, preferably all the way to the base plate. Accordingly, the cover is semi-cylindrical and the semi-circular platform 40 which is recessed within an upper end of cover sleeve 38, preferably coextensive therewith. The cover sleeve 38 is also secured to vertical ribs 54 which extend between and are secured to the base plate 28 and platform 40. The base plate 28, the vertical ribs 54, and platform 40 thus constitute an outer frame means to which cover sleeve 38 is attached.

The tubular member 24 preferably extends above the top member 25 and presents an open end 47 for receiving a ball retriever, an additional club, an umbrella or other elongated piece of golf equipment. As shown in FIG. 1, an umbrella 52 has been opened and inserted into the upper open end of tubular member 24 to provide protection for the clubs and other golf equipment supported upon the carrier. By extending the tubular member 24 above the top member 25, a support is formed for ball holders, as shown.

As explained in the prior patents, the vertically elongated club receiving frame 26 can be rotated to position any club within opening 39 for insertion or withdrawal from the carrier.

Figure 3:
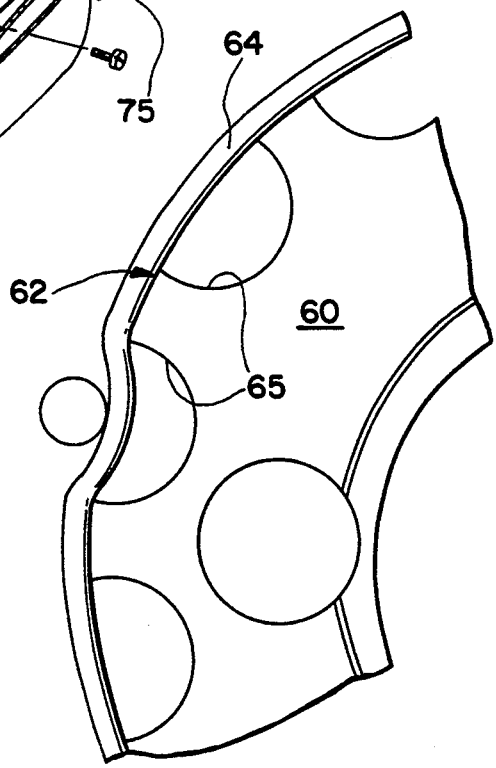
FIG. 3 is an enlarged fragmental detail view of the new retaining disc or snubber.

A major feature of the present invention is an improved shaft retaining means comprising a disc 60 (FIGS. 2 and 3), constructed for example from polypropylene, having an outer annular slot or recess 62 receiving a resilient band 64 (such as a large 0-ring). In the periphery of disc 60 are a number of cut-outs or recesses 65, conveniently of arcuate shape as shown, arranged to be located where club shafts pass when in position on the frame. Disc 60 is secured to the tubular member 24 intermediate the bottom member 28 and a top member 25 such that band 24 engages club shafts where the band is not seated in slot 62; see FIG. 3. This provides sufficient holding force transverse to the club shaft without tending to induce a slight bend in such shaft.

The force exerted by the club retaining means is sufficient to hold the clubs firmly on the frame 26 and substantially prevent rotation of the clubs when supported on the carrier, while accommodating a variety of club shaft diameters, and, by firmly holding the clubs against rotation, preventing jostling of the club heads.

Figure 4:
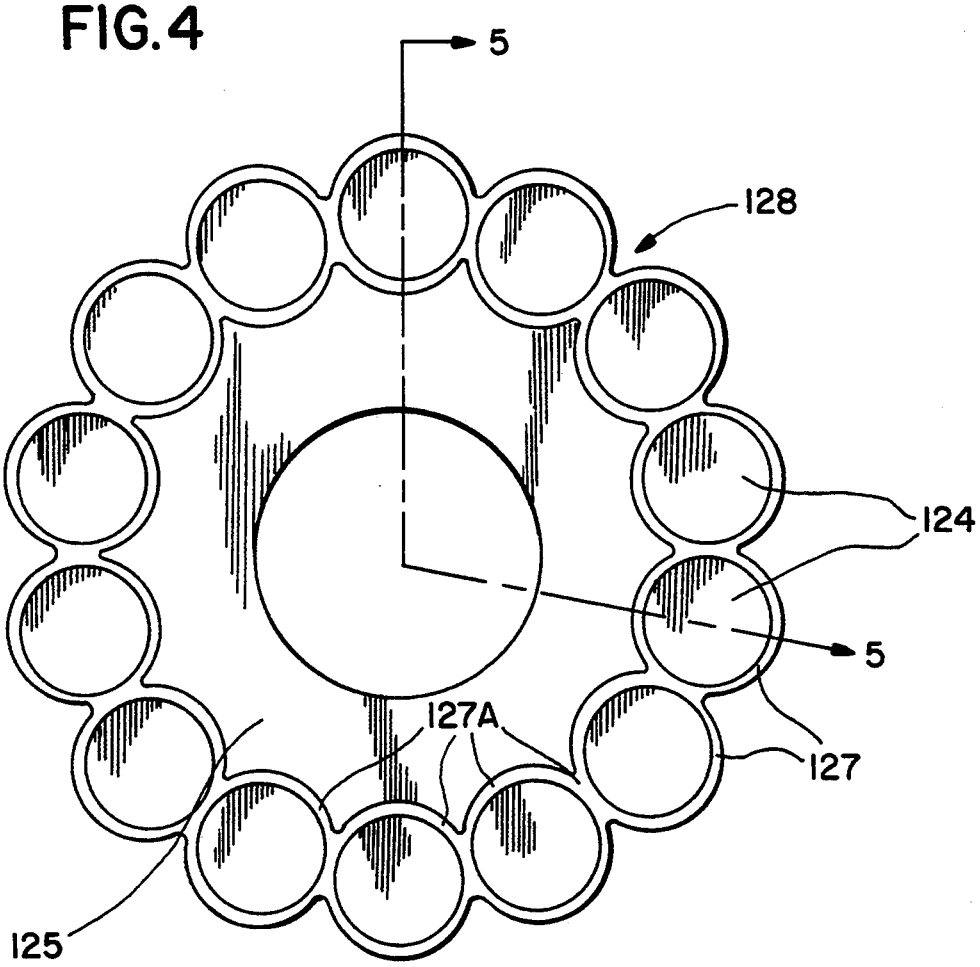
FIG. 4 is a sectional view taken through the carrier above the bottom of the frame, showing in plan an improved cupped bottom member.
Figure 5:
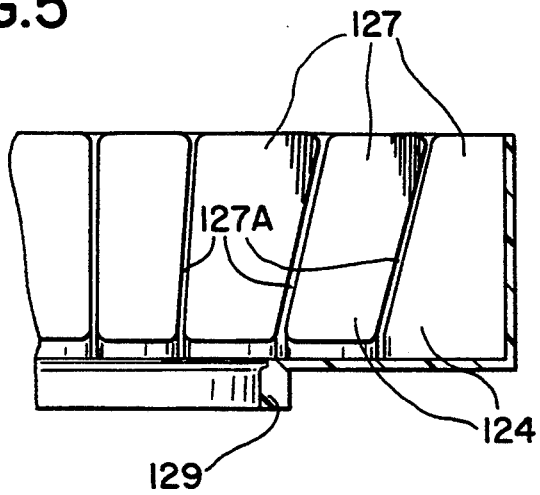
FIG. 5 is an enlarged fragmental view of a portion of the improved bottom member and its shaft end receiving cups.

The present invention also provides an optional improved construction of carrier bottom member 28 in the form of a unitary molded plastic part, shown in FIGS. 4 and 5. This part 128 incorporates fourteen cup members 124 in place of the relatively shallow sockets disclosed in the earlier patents and shown in FIG. 2. Part 128 is integrally formed with the cup members and a central disc 125 and a hub 129 which can be fastened with set screws (not shown) to the lower end of tubular member 24; preferably the part is molded of a suitable plastic material. Each of the cup members 124 has arcuate walls 127 which are considerably higher at the exterior of the member, and short at the interior, as best seen in FIG. 5, to present inward and downward sloping cup rims 127A. Walls 127 provide separation between adjacent cup members, as can be seen.

The advantage of bottom member 128 is that the exterior portions of the cup walls, at the perimeter of the member 128, are sufficiently high that they prevent the butt ends of clubs from being jostled out of the cups, and in cooperation with the improved shaft retaining means they improve retention of the clubs within the carrier. On the other hand, the much lower innermost cup walls allow the butt of a club shaft to be inserted or removed with ease.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a golf equipment carrier, a club holding frame comprising:

a bottom member having a plurality of upwardly facing cup members arranged in at least one circle of predetermined radius to receive handle ends of inverted clubs, a top member having a plurality of pockets corresponding in number to said cup members and arranged inwardly of the periphery of said top member in a pocket circle of approximately the same radius as the cup member circle for receiving the shank portions of the clubs, the top member having slots extending inward from its periphery to adjacent one side of said pockets and a corresponding number of narrow passages connecting said slots to said pockets providing passages for inserting and removing the shank end of a club shaft with respect to the related pockets, and a shaft centrally connecting the centers of said top and bottom members and spacing said top and bottom members from one and other to form an elongated club receiving frame;

the improvement comprising shaft retaining means comprising a disc member mounted on said shaft and having a rim of a radius slightly greater than the radius of at least one of the cup member circle and pocket circle, said disc member having a plurality of recesses around its rim corresponding in number and in peripheral alignment to said cup members and being of a depth sufficient to pass the shafts of clubs inserted into said club receiving frame, each said recess having an open face presented radially outward of said disc member, a resilient band extending about said rim of said disc member and having portions traversing the open faces of said recesses whereby only said portions of said band exert a holding force against the shaft of each club inserted into said holding frame, said bottom member being formed as an integral member having said cup members defined by walls separating the cup members from each other, said walls of said cup members sloping downward and inward of said bottom member and terminating in radially inwardly edges, and therefore being of greater height at the perimeter of said bottom member than at the radially inward edges of said cup members.

2. A club holding frame constructing for a golf equipment carrier, comprising:

a bottom member having a plurality of upwardly facing cup members, each of equal diameter, having centers arranged in a circle of predetermined radius to receive the butt ends of inverted golf clubs, a top member having a plurality of pockets corresponding in number to said cup members and arranged inwardly of the periphery of said top member in a pocket circle of approximately the same radius as said cup member circle for receiving the shank portions of the clubs, the top member having slots extending inward from its periphery to adjacent one side of said pockets and a corresponding number of narrow passages connecting said slots to said pockets providing passages for inserting and removing the shank end of a club shaft into and out of the related pockets, and a shaft centrally connecting said top and bottom members on the axes of said circles and spacing said top and bottom members from one and other by a distance less than the length of the shortest golf club to form an elongated club receiving frame; the improvement comprising a circular disc member mounted on said shaft approximately midway between said top member and said bottom member, said disc having a rim of a radius slightly greater than the radius of at least one of the cup member circle and pocket circle, a groove formed in and extending around said rim of said disc member, said disc member having a plurality of separate recesses spaced around said rim corresponding in number to and being in vertical alignment with said cup members, each said recess having an open face presented radially outward of said disc member at said rim and having a depth sufficient to prevent contact thereof with shafts of clubs inserted into the frame, a resilient band extending about said rim of said disc member within said groove and traversing the open faces of said recesses in radially spaced relation thereto such that only tension in said band exerts a holding force against the shaft of each club inserted into said holding frame.

* * * * *